United States Patent [19]

Tanquary

[11] 4,094,945

[45] June 13, 1978

[54] SPINNING OF POLYPYRROLIDONE

[75] Inventor: A. Charles Tanquary, Birmingham, Ala.

[73] Assignee: Chevron Research Company, San Francisco, Calif.

[21] Appl. No.: 714,461

[22] Filed: Aug. 16, 1976

[51] Int. Cl.[2] ..... D01F 6/00

[52] U.S. Cl. ..... 264/184; 260/33.8 R; 260/78 P; 264/203; 264/205

[58] Field of Search ..... 260/33.8 R, 78 P; 264/184, 205, 203

[56] References Cited

U.S. PATENT DOCUMENTS

| | | | |
|---|---|---|---|
| 2,216,835 | 10/1940 | Carothers | 260/33.8 R |
| 2,374,126 | 4/1945 | Peters | 260/33.8 R |
| 2,711,398 | 6/1955 | Barnes | 264/216 |
| 2,919,257 | 12/1959 | Blake et al. | 260/33.8 R |
| 3,003,985 | 10/1961 | Black | 260/78 P |
| 3,042,647 | 7/1962 | Black | 260/78 P |
| 3,070,562 | 12/1962 | Koller | 260/33.8 R |
| 3,117,941 | 1/1964 | Knobloch et al. | 260/33.8 R |
| 3,143,527 | 8/1964 | Wittbecker | 260/33.8 R |

*Primary Examiner*—Jay H. Woo

*Attorney, Agent, or Firm*—Dix A. Newell; Thomas G. DeJonghe

[57] ABSTRACT

Polypyrrolidone solutions having a bulk viscosity of 100–10,000 poises, and containing a solvent such as formic acid and a volatile diluent such as methylene chloride, are spun into filaments by extrusion through a spinneret. The solution contains, for example, about 5–40 weight percent of polypyrrolidone, about 30–90 weight percent of formic acid and about 5–60 weight percent of methylene chloride.

10 Claims, No Drawings

SPINNING OF POLYPYRROLIDONE

BACKGROUND OF THE INVENTION

1. Field of the Invention

Polypyrrolidone (nylon-4) can be spun into fiber having useful properties. The polymer is produced by the alkaline-catalyzed polymerization of 2-pyrrolidone (see U.S. Pat. No. 3,721,652) and is spun into filament by extrusion from multi-hole spinnerets. Melt spinning is accomplished by extruding the polymer in a molten condition, but at melt temperatures the polymer tends to degrade and revert to monomer. Several other spinning processes are at least hypothetically applicable to polypyrrolidone spinning, but they depend on the extrusion of a polymer solution. In dry spinning, a solution of polymer is extruded into a heated zone in which the solvent evaporates and from which the filaments are collected. In wet spinning, a solution of polymer is extruded into a liquid bath in which the solvent is at least partially removed from the filament and from which the filaments are collected. Wet spinning is carried out at much lower temperatures than melt spinning and, normally, at substantially lower temperatures than dry spinning. In the little used process of gap spinning, a solution of the polymer containing a volatile diluent is extruded into a heated zone. The volatile diluent evaporates in the "gap" between the spinneret and a liquid bath. Normally, substantial amounts of solvent and diluent are removed from the filament in the liquid bath and the filament is then collected. Dry, wet and gap spinning processes are herein referred to as "solution spinning."

2. Prior Art

Relevant articles on the spinning of fiber-forming polymers can be found in "Man-Made Fibers, Science and Technology", Volume 1, H. F. Mark et al. Ed., Interscience Publ., New York.

U.S. Pat. Nos. 2,711,398 and 3,060,141 disclose the spinning of polypyrrolidone from meta-cresol or formic acid solutions and aqueous formic acid solutions respectively. U.S. Pat. No. 2,734,043 teaches the dilution of fiber-forming formic acid solutions of polypyrrolidone with aliphatic and chloroaliphatic acids. U.S. Pat. Nos. 2,980,641, 3,003,984, 3,033,810 and 3,042,647 disclose wet spinning solutions of polypyrrolidone comprising phytic acid, trichlorinitropropanol, ferric chloride, and chlorinated phenol, respectively. U.S. Pat. Nos. 3,076,774 and 3,324,061 report the dry spinning of polypyrrolidone from aqueous solutions prepared from superheated water, 120°–180° C.

BRIEF SUMMARY OF THE INVENTION

A filament-forming composition of matter has a bulk viscosity of about 100–10,000 poises, and comprises polypyrrolidone, a solvent for polypyrrolidone such as formic acid and a volatile diluent such as methylene chloride. Self-sustaining filaments are formed by extruding the composition through a spinneret.

DESCRIPTION OF PREFERRED EMBODIMENTS

The Filament-Forming Composition

The present invention provides a filament-forming composition of matter which is suitable for the solution spinning of polypyrrolidone. By the practice of this invention, high-molecular-weight polypyrrolidone is easily spun into filaments without degradation of its molecular weight. Fibers produced by solution spinning of high molecular weight polypyrrolidone according to the present invention have inherent viscosities of 2.0 dl/g or more. Melt-spun fibers, historically, have inherent viscosities of about 1.0 dl/g regardless of the initial molecular weight of the polypyrrolidone. Aqueous acid solutions are also believed to degrade the polymer. The solution-spun fibers of the present invention not only have an inherent viscosity similar to that of the polypyrrolidone starting resin, but also show a surprising resistance to fibrillation. The compositions of the present invention may also be utilized for the solution extrusion of film, tubing and other articles.

The filament-forming composition of matter comprises polypyrrolidone, a solvent and a volatile diluent. The fiber-forming composition is amenable to spinning into self-sustaining filaments, such as, filaments which have sufficient tensile strength to be collected, dried, tensioned, oriented by drawing, crimped, heat set and woven into useful textiles. The composition is characterized by a bulk viscosity under spinning conditions which is suitable for the formation of self-sustaining filaments, more specifically, by a bulk viscosity at 20° C of about 100–10,000 poises, and preferably about 1,000–5,000 poises. Bulk viscosity is measured by the Brookfield Viscometer (20°–22° C).

The polypyrrolidone is a white, solid resin, having an inherent viscosity greater than about 1.0 dl/g, and preferably greater than about 1.5 dl/g. The solvent is one of those suitable for the dissolution of polypyrrolidone to provide a solution of sufficient viscosity at ordinary solution spinning temperatures, such as formic acid, meta-cresol or phenol, preferably meta-cresol or formic acid, and most preferably formic acid. Solutions containing only formic acid and polypyrrolidone are not found to be easily solution-spun into acceptable fibers because the extrudate tends to stick to the spinneret and produce weak fibers.

The volatile diluent is a liquid which is totally miscible with the polypyrrolidone solution at 5 weight percent or more of volatile diluent, based on the total weight of the composition. The volatile diluent has a normal boiling point of about 15°–75° C. Such volatile diluents include methylene chloride, chloroform, and ethyl chloride.

Methylene chloride (dichloromethane) is the preferred volatile diluent. Preferably, the fiber-forming solution is reasonably stable over a period of time without degradation of the polypyrrolidone or decrease in the bulk viscosity, and without precipitation. Ordinarily, the solution is formed by the mixing of the solvent and volatile diluent followed by the addition of polypyrrolidone, because the viscous polypyrrolidone solutions are difficult to mix with volatile diluent. Methylene chloride is preferred, among other reasons, because it is miscible with polypyrrolidone solutions over a wide range of methylene chloride content and has a surprisingly small effect on the bulk viscosity of a formic acid/polypyrrolidone solution when substituted for formic acid. For example, a formic acid/polypyrrolidone solution (20% polypyrrolidone of about 110,000 weight average molecular weight) has a bulk viscosity of 850 poises and replacing half the formic acid with methylene chloride on a weight basis changes the viscosity by less than 10%. On the other hand, replacing half the formic acid with water would reduce the viscosity to less than one-fourth of its formic acid solution value. Furthermore, water/formic acid solutions of polypyrrolidone lose viscosity on storage over a period of even a single day. This is believed to be caused by acid-hydrolysis of the polymer. Methylene chloride/-formic acid solutions of polypyrrolidone, on the other hand, were found to be about as stable as formic acid solutions of polypyrrolidone.

Another advantage following the use of a volatile diluent in a polypyrrolidone solution is that the bulk viscosity of the solution increases rapidly as the weight percent of solids in the solution increases. Since the spinning of polypyrrolidone solutions is greatly facilitated if the viscosity of the solution increases rapidly as the filament emerges from the spinneret, it is advantageous to use a volatile diluent which is rapidly removed from the solution either by heating the filament or washing it in an appropriate liquid bath. The removal of the volatile diluent rapidly increases the bulk viscosity of the solution to yield a self-sustaining filament which is easily collected.

The preferred filament-forming composition of the present invention comprises about 5–40 weight percent of solid polypyrrolidone (this is referred to as the "solids" content or level of the solution), about 30–90 weight percent of solvent and about 5–60 weight percent of a volatile diluent. Preferably, the solids content is about 10–30 weight percent. Additionally, these solutions will have a bulk viscosity of 100–10,000 poises, preferably about 1000–5000 poises. The most preferred solutions are polypyrrolidone/formic acid/methylene chloride solutions of filament-forming viscosity. Generally, these solutions may contain minor, but effective, amounts of anti-oxidants, thermal and ultra-violet stabilizers, dyes or pigments, whiteners, fire retardants, delusterants, and other polymers such as polyolefins, or polyamides, or copolymers. A minor amount of water, less than 5 weight percent, and preferably less than about 1 percent, may be present in the solution. The solution spinning compositions of this invention also comprise other minor ingredients which provide anisotropy to the solution, or greater orientation to the undrawn or drawn filament, or higher initial modulus, tenacity etc. The total amount of these minor ingredients will generally not exceed about 10 weight percent of the filament-forming composition based on the total weight of the composition.

The specified viscosity of the spinning dope, the boiling point of the volatile diluent, the specified composition of the spinning dope and the relative proportions of polypyrrolidone, volatile diluent and solvent have been given in their preferred ranges. It is understood that these are not intended to be limitations to spinning, since it may be possible to achieve satisfactory spinning results for certain purposes outside the preferred ranges, or to provide critical conditions for the formation of anisotropic solutions, or more highly oriented fibers, or fibers of higher initial modulus or tenacity etc.

The Filament-Forming Process

The spinning process basically consists of extruding a filament-forming solution through a spinneret and collecting the filament(s). Preferably, steps are taken during collection of the filaments to wash and/or dry them of solvent and volatile diluent. The filaments are preferably tensioned and at least partially oriented by drying during and/or after their collection.

The solution temperature during spinning is not critical except to the extent that the bulk viscosity of the solution is temperature-dependent and filament-forming conditions must be maintained. Also, an important advantage of solution spinning is its utility for low temperature spinning and temperatures much lower than those necessary for melt spinning. Consequently, spinning at solution temperatures of 20°–150° C and preferably 20°–40° C is suggested, but operation outside these limits may be desirable for certain purposes.

In a preferred embodiment of the invention, the extruded filament is allowed to contact a liquid bath after leaving the orifice of the spinneret. The bath serves the purpose of removing substantial amounts of solvent and volatile diluent from the filament without debilitating its tensile properties. Water, or even alcohols, are not preferred liquids for this purpose. Lower alkyl esters of alkanoic acids and lower alkyl ketones are preferred. The lower alkyl esters of alkanoic acids such as methyl formate, methyl acetate, ethyl formate, butyl propionate, hexyl acetate, etc. and mixtures thereof, are most preferred. The bath temperatures will normally be about room temperature and well below the boiling point of the liquid bath, preferably about 20°–150° C, most preferably about 25°–90° C. The length of the bath trough and the time of emersion are normally those selected for convenience, efficient removal or volatile diluent and solvent, and the overall improvement of filamentary properties.

In a preferred embodiment of the invention, the extruded filament passes through a relatively warm drying zone before it is allowed to contact the liquid bath. The drying zone serves the purpose of volatilizing the diluent, thereby increasing the solids content and viscosity of the filament before it enters the liquid bath. Heat is provided to the filament in the drying zone by any convenient means including radiant heat and/or hot air currents applied to the filament while moving through a heating column. The temperature in the filamentary path may be of the other of the approximate boiling point of the volatile diluent, although due to volatilization of the diluent the temperature of the filament will normally not be that high. After leaving the drying zone, the filament is allowed to contact the liquid bath, as described above, and is collected for further processing.

In embodiments of dry, wet or gap spinning, the length of the liquid bath trough, the boiling point of the liquid bath fluid, the time of immersion, the draw down in the bath, the length of the drying zone and its temperature, the ratio of the length of the spinneret to the orifice diameter, etc., are matters of choice within the objective of achieving an overall improvement in filamentary and yarn properties for a particular purpose and a particular spinning dope.

In addition to polypyrrolidone compositions, it is expected that filament-forming solutions of other high-melting, moisture-sorptive nylons can be formed and spun according to the present invention by substituting polypeptides (nylon-2 derivatives), poly-beta-alanine (nylon-3), polyazetidinones (nylon-3 derivatives), poly-1,4-butylenesuccinamide (nylon-44) and polypiperidone (nylon-5) for polypyrrolidone.

EXEMPLIFICATION

Example 1 illustrates the rapid rise in viscosity of the spinning composition which is caused by the loss of diluent from the composition. Example 2 demonstrates the stability of a spinning composition of the present invention.

EXAMPLE 1

A solution containing 12 weight percent of polypyrrolidone (weight average molecular weight 305,000), 44% formic acid and 44% methylene chloride has a bulk viscosity of about 1,000 poises. Removal of all methylene chloride provides a solution containing 21% polypyrrolidone and 79% formic acid. The viscosity of this solution was estimated by extrapolation to be over 100,000 poises.

EXAMPLE 2

Portions of polypyrrolidone (110,000 molecular weight) having an inherent viscosity of 2.52 dl/g (measured from a solution of 0.5 g polymer/dl, at 30° C, in 88% formic acid) were dissolved in formic acid alone and in a 1:1 mixture by weight of formic acid and methylene chloride. After aging for several days, films were cast from the aged solutions. The films were dried overnight and then their inherent viscosities were measured. The film from the formic acid solution (2.42 dl/g) and the 1:1 formic acid/methylene chloride solution (2.41 dl/g) showed little difference in inherent viscosity from that of the original polymer (2.52 dl/g). Longer-range stability tests indicate that unlike aqueous acid solutions of nylon-4, solutions of nylon-4 in methylene chloride/formic acid are still useful for spinning acceptable fibers even after 14 days. In one test, the inherent viscosity of the polymer dropped slightly from 3.73 to 3.59 dl/g over that period of time.

Examples 3 and 4 show dry spinning runs.

EXAMPLE 3

Polypyrrolidone of 110,000 weight average molecular weight was mixed with a 50/50 weight percent solvent/diluent mixture of formic acid/methylene chloride. The filament-forming solution had a solids level of 23% and a bulk viscosity of about 2000 poises. A portion of the solution was charged to a 130 ml feed reservoir and forced by nitrogen pressure (100 psi) through a screen pack (40 mesh and 250 mesh screens) and a spinneret (single orifice of 10 mil diameter). From the spinneret the monofilament passed in front of a 1,100 watt radiant heater for about 2 feet. The temperature along the filament drying zone was about 120° C. No difficulties were encountered in collecting monofilament of about 350 denier.

EXAMPLE 4

In some other dry spinning experiments a Model 955 Leesona winder was installed about three feet from the fiber guide and a heating column (2×24 inches) was installed below a 20 mil orifice spinneret. Table I lists several spinning solutions dryspun under the following conditions. Process conditions consisted of a column temperature of 130° C, nitrogen feed pressure of 10–20 psi and take-up speeds of 7.5–10 ft/min. The undrawn monofilament was dried for 48 hours prior to testing its tensile properties which included, for example, a tenacity of 0.84 q/d and a tensile factor of 20.5 for a 94 denier filament spun from solution Example 4c.

TABLE I

| | Compositions | | |
|---|---|---|---|
| | Polypyrrolidone Molecular Weight | solids, wt. %[1] | Bulk Viscosity, Poises |
| Example 4a | 152,000 | 19.0 | 1,600 |
| Example 4b | 225,000 | 17.5 | 2,900 |

TABLE I-continued

| | Compositions | | |
|---|---|---|---|
| | Polypyrrolidone Molecular Weight | solids, wt. %[1] | Bulk Viscosity, Poises |
| Example 4c | 305,000 | 13.5 | 2,000 |

[1]Polypyrrolidone in 50/50 weight percent formic acid/methylene chloride

Examples 5 and 6 illustrate the use of water and a lower alkyl ester of an alkanoic acid, respectively, as a bath fluid in wet spinning. Tables II and IV show the excellent tensile properties obtainable from drawn fibers of polypyrrolidone produced by solution spinning according to the present invention.

EXAMPLE 5

When the filament-forming solution of Example 3 was extruded directly into water at about 65° C, the methylene chloride flashed off vigorously and the filamentary structure was disrupted. The polymer mass appeared weak and opaque. When the same solution was extruded into water at 35° C, the methylene chloride did not evaporate as rapidly and the filament retained its shape, but was relatively weak as before.

EXAMPLE 6*a–b*

(a) In another series of experiments otherwise similar to dry spinning Example 4, filament-forming solutions were extruded from a spinneret into an ethyl acetate bath. Strong filaments formed quickly. Similar results were obtained at room temperature baths and at 30° C baths. (b) A filament-forming solution containing 15.5 weight percent polypyrrolidone (295,000 molecular weight), 38% formic acid and 46.5% methylene chloride was extruded from a 10-hole spinneret (20 mil diameter orifices). The extrusion was metered by a pump operating a 7 rpm. The filament was immersed in a 54-inch bath of ethyl acetate. The multifilament was pulled over a glass godet, operating at 10 ft/min and then six turns were taken around a pair of metal godets, heated to 50° C and running at 13.5 ft/min. The yarn packages were dried overnight at room temperature in vacuo and then oriented by drawing 3X at 175° C. Table II gives the tensile properties of this multifilament.

TABLE II

| | Tensile Properties of Wet-Spun Polypyrrolidone Multifilament | | | |
|---|---|---|---|---|
| Denier | Tenacity g/d | Elongation at Break % | Tensile Factor | Initial Modulus g/d |
| 1003 undrawn | 0.66 | 165 | 8 | 4 |
| 335 drawn | 3.2 | 11 | 11 | 27 |
| 325 drawn | 3.2 | 10 | 10 | 27 |

The following example illustrates the process of gap spinning of nylon-4.

EXAMPLE 7

A 500-ml reservoir was charged with the filament-forming solution described in Example 6*b*. The solution was forced by nitrogen at 140 psi (Example 7*a*) or 200 psi (Example 7*b*) from the reservoir to a Zenith gear pump. The solution was pumped through a stainless steel screen pack containing 40- and 250-mesh screens. A monofilament was extruded through a spinneret with either a 20-mil (7*a*) or a 6-mil (7*b*) orifice and then allowed to pass vertically near two (7*a*) or three (7*b*) sets of 250-watt infrared lights. The lights were positioned about 2.5 in. from the fiber path. The temperature in the fiber path was 120° C (7*a*) or 200° C (7*b*). 24 in. below the spinneret the monofilament entered a 45 in. trough containing ethyl acetate. The filament passed through the bath, around a glass godet, over a first pair of unheated godets and finally took several turns around a pair of heated metal godets at 100° C. Fiber samples were collected on a Leesona winder. The yarn packages were dried 12 hours under vacuum to remove residual formic acid and ethyl acetate. The process variables are listed in Table III and the tensile properties of the fiber are given in Table IV. Each datum in Table IV is an average of 10 experiments. The drawn fibers show excellent tenacity, initial modulus and tensile factor (square root of percent elongation at break times tenacity).

TABLE III

| | Gap-Spinning Process | | | |
|---|---|---|---|---|
| Example | 7a[1] | 7a[2] | 7b[1] | 7b[2] |
| Molecular weight, $\times 10^{-3}$ | 295 | 295 | 295 | 295 |
| Spinneret orifice, mil | 20 | 20 | 6 | 6 |
| Nitrogen pressure, psi | 140 | 140 | 200 | 200 |
| Column temperature, ° C | 120 | 120 | 200 | 200 |
| Pump speed, rpm | 5 | 7 | 1.5 | 1.5 |
| Glass godet, ft/min | 10.5 | 31 | 45 | 51 |
| First godets, ft/min | 12 | 31 | 49 | 57 |
| Second godets, ft/min | 21 | 62 | 50 | 65 |
| Filament cross section | kidney | kidney | round | round |

TABLE IV

| | Tensile Properties of Gap-Spun Fibers | | | | | |
|---|---|---|---|---|---|---|
| Ex. | Draw at 175° C | Denier | Tenacity g/d | Elongation at Break % | Tensile Factor | Initial Modulus g/d |
| 7a[1] | undrawn | 80 | 0.87 | 220 | 13.0 | 15.5 |
| 7a[1] | 3× | 27 | 3.40 | 27 | 16.5 | 27.0 |
| 7a[2] | undrawn | 76 | 0.88 | 243 | 13.7 | 9.8 |
| 7a[2] | 2× | 45 | 1.84 | 82 | 16.7 | 17.2 |
| 7b[1] | undrawn | 52 | 1.05 | 297 | 17.9 | 9.0 |
| 7b[1] | 3× | 16 | 4.21 | 20 | 19.0 | 29.2 |

TABLE IV-continued

| | Tensile Properties of Gap-Spun Fibers | | | | | |
|---|---|---|---|---|---|---|
| Ex. | Draw at 175° C | Denier | Tenacity g/d | Elongation at Break % | Tensile Factor | Initial Modulus g/d |
| 7b[2] | undrawn | 44 | 1.21 | 264 | 19.7 | 10.0 |
| 7b[2] | 3× | 14 | 4.91 | 16 | 19.6 | 44.5 |

What is claimed is:

1. A process for forming filaments of polypyrrolidone which comprises extruding through a spinneret a solution comprising polypyrrolidone, formic acid and methylene chloride.

2. A process in accordance with claim 1 wherein the amount of polypyrrolidone in the solution is 5–40 weight percent, the amount of formic acid is 30 to 90 weight percent and the methylene chloride is 5 to 60 weight percent.

3. A process in accordance with claim 2 wherein the amount of polypyrrolidone in the solution is 10 to 30 weight percent.

4. A process in accordance with claim 3 wherein the amount of polypyrrolidone in the solution is about 12 to 23 weight percent and the ratio of formic acid to methylene chloride is about 1 to 1 by weight.

5. A process in accordance with claim 3 wherein the solution has a bulk viscosity of about 1,000 to 5,000 poises.

6. A process in accordance with claim 3 wherein the filaments are withdrawn from the spinneret into a liquid bath.

7. A process in accordance with claim 6 wherein the liquid bath comprises the lower alkyl ester of an alkanoic acid.

8. A process in accordance with claim 7 wherein the liquid bath comprises a major amount of ethyl acetate.

9. A process in accordance with claim 6 wherein the filaments are withdrawn from the spinneret into a relatively warm drying zone and thereafter are passed into the liquid bath.

10. A process in accordance with claim 9 wherein the liquid bath comprises a major amount of methyl acetate.

* * * * *